US005188930A

United States Patent [19]

Funaki et al.

[11] Patent Number: 5,188,930

[45] Date of Patent: Feb. 23, 1993

[54] PHOTOGRAPHIC FILM OF SYNDIOTACTIC STYRENE POLYMER

[75] Inventors: Keisuke Funaki, Ichihara; Yuichi Ohki, Himeji, both of Japan

[73] Assignee: Idemitsu Kosan Co., Ltd., Tokyo, Japan

[21] Appl. No.: 800,762

[22] Filed: Dec. 2, 1991

Related U.S. Application Data

[63] Continuation of Ser. No. 592,800, Oct. 4, 1990, abandoned.

[30] Foreign Application Priority Data

Oct. 18, 1989 [JP] Japan ..... 61-269090

[51] Int. Cl.[5] ..... G03C 1/76

[52] U.S. Cl. ..... 430/536; 430/531; 430/532; 427/520; 156/308.8; 156/309.3

[58] Field of Search ..... 430/523, 531, 532, 536, 430/271; 156/308.8, 309.3; 427/40, 44, 54.1

[56] References Cited

U.S. PATENT DOCUMENTS

| | | | |
|---|---|---|---|
| 2,816,027 | 12/1957 | Farrell et al. | 96/97 |
| 3,549,608 | 12/1970 | Coover et al. | 260/93.7 |
| 3,639,332 | 2/1972 | Coover et al. | 260/93.7 |
| 4,579,814 | 4/1986 | Ryan | 430/536 |
| 4,862,167 | 2/1989 | Tatsuta et al. | 430/536 |

*Primary Examiner*—Jack P. Brammer

*Attorney, Agent, or Firm*—Oblon, Spivak, McClelland, Maier & Neustadt

[57] ABSTRACT

A photographic film which comprises (A) a stretched film of a styrene polymer having a syndiotactic configuration or a composition containing it, wherein thickness is 20 to 500 μm, haze is not more than 3% and moisture expansion coefficient is not more than $1\times10^{-6}$/% RH, and (B) a photosensitive layer, which is light and excellent in mechanical properties, is disclosed.

13 Claims, No Drawings

PHOTOGRAPHIC FILM OF SYNDIOTACTIC STYRENE POLYMER

This application is a continuation of application Ser. No. 07/592,800, filed Oct. 4, 1990 now abandoned.

BACKGROUND OF THE INVENTION

1. Field of the Invention

The present invention relates to a photographic film, more particularly, it relates to a photographic film which comprises a specific base film layer and photosensitive layer, and is light and excellent in mechanical properties and further has good dimensional stability.

2. Description of the Related Arts

Hitherto, as base films of photographic film, a film of cellulose polymer, a film of polyester, a film of polystyrene having an atactic configuration and the like have been used. Particularly, as bases of films other then rolled films, polyester films excellent in dynamic properties and well-balanced in other properties have been used.

However, a film of cellulose polymer is produced by wet method, resulting in high cost and insufficient mechanical strength. On the other hand, polyester film has some defects. For example, it has high specific gravity and is easily affected by moisture. Accordingly, when it is dried at high temperature while containing moisture, it may be degraded by hydrolysis. When it is used around room temperature, dimensional change attributable to moisture change may occur (moisture expansion coefficient: 1 to $2\times10^{-5}$/%RH). Therefore, improvement has been expected in the application wherein accuracy is required, for example, as a master film. Films of polystyrene having an atactic configuration are excellent in transparency, moisture dimensional stability, water absorption and the like, but inferior in heat resistance and mechanical properties.

As mentioned above, the conventionally used base films have various problems, and properties of photographic films obtained from them are not always satisfactory.

The present inventors have studied intensively to develop photographic film with better properties. As the result, it has been found that a styrene polymer having a syndiotactic configuration or a composition thereof has markedly lower moisture expansion coefficient than the conventional heat resistant resin, and is suitable as a raw material for photographic film. Further, it has been found that the above object may be achieved by photographic film using a film with a specific thickness, haze and moisture expansion coefficient as a base film. The present invention has been attained based on such findings.

SUMMARY OF THE INVENTION

That is, the present invention provides a photographic film which comprises (A) a stretched film layer of styrene polymer having a syndiotactic configuration or a composition containing it which has thickness of 20 to 500 μm, haze of not more than 3%, moisture expansion coefficient of $1\times10^{-6}$/%RH (hereinafter referred to as layer A) and (B) a photosensitive layer (hereinafter referred to as layer B).

As the layer A of the present invention which is a so-called base film in a photographic film, a styrene polymer having a syndiotactic configuration or a composition containing the polymer as one component is used.

Here, a styrene polymer having a syndiotactic configuration means a styrene polymer wherein the stereostructure in which phenyl groups or substituted phenyl groups as side chains are located alternately in opposite directions relative to the main chain consisting of carbon-carbon bonds. Generally, stereoregularity (tacticity) is quantitatively determined by the nuclear magnetic resonance method $^{13}$C-NMR method) using carbon isotope with high accuracy. The tacticity measured by the $^{13}$C-NMR method can be indicated in terms of proportions of structural units continuously connected to each other, i.e., a diad in which two structural units are connected to each other, a triad in which three structural units are connected to each other and a pentad in which five structural units are connected to each other. The styrene polymer having a syndiotactic configuration in the present invention means styrene polymer having such a stereoregularity that the proportion of racemic diad is at least 75%, preferably at least 85%, or proportions of racemic pentad is at least 30% and preferably at least 50%. The styrene polymer includes polystyrene, poly(alkylstyrene), poly(halogenated styrene), poly(halogenated alkylstyrene), poly(alkoxystyrene), poly(vinyl benzoate), hydrogenated polymers thereof and a mixture thereof, or copolymers containing these structural units. Here, the poly(alkylstyrene) includes poly(methylstyrene), poly(ethylstyrene), poly(propylstyrene), poly(butylstyrene), poly(phenylstyrene), poly(vinylnaphthalene), poly(vinylstyrene), poly(acenaphthylene); and the poly(halogenated styrene) includes poly(chlorostyrene), poly(bromostyrene) and poly(fluorostyrene). The poly(alkoxystyrene) includes poly(methoxystyrene), poly(ethoxystyrnene).

Comonomer of the copolymer containing these structural units includes, in addition to the above-described monomers of styrene polymer, olefin monomer such as ethylene, propylene, butene, hexene, octene; diene monomer such as butadiene, isoprene; cyclic olefin monomer, cyclic diene monomer or polar vinyl monomer such as methyl methacrylate, maleic anhydride, acrylonitrile.

Among them, a particularly preferred styrene polymer includes polystyrene, poly(alkylstyrene), hydrogenated polystyrene and a copolymer containing there structural units.

Molecular weight of the styrene polymer is not particularly limited, but the styrene polymers having weight average molecular weight of 10,000 to 3,000,000, especially, 50,000 to 1,500,000 are most suitable. Further, the range of molecular-weight distribution is not limited and various styrenes can be used. The value, weight average molecular weight (Mw)/number average molecular weight (Mn) is preferably 1.5 to 8. The styrene polymer having a syndiotactic configuration is much superior in heat resistance to the conventional styrene polymer having an atactic configuration.

Such styrene polymer having a syndiotactic configuration may be produced, for example, by polymerization of styrene monomer (monomer corresponding to the above styrene polymer), in the presence of or in the absence of an inert hydrocarbon solvent using a titanium compound and a reaction product of water and trialkylaluminum as catalysts (see Japanese Patent Application Laid-Open No. 187708/1987). Poly(halogenated alkylstyrene) and hydrogenated polymer thereof may be obtained by the methods described in Japanese Patent Application Laid Open Nos. 46912/1989 and 178505/1989, respectively.

For the layer A of the present invention, the above styrene polymer is basically used in the form of a film. Further, other resin components may be compounded considering moldability, mechanical properties, surface properties and the like.

For example, styrene polymer having an atactic configuration or an isotactic configuration, polyphenylene ether and the like may be readily compatibilized with the above styrene polymer having a syndiotactic configuration and effective to control crystallization when pre-molded product for stretching is prepared, thereby providing a film with enhanced stretching properties and excellent mechanical properties, whose stretching conditions may be readily controlled. When styrene polymer having an atactic and/or isotactic configuration is compounded, it is preferably composed of the same monomers as those of the styrene polymer having a syndiotactic configuration. The content of the compatible resin component is 70 to 1 wt%, preferably, 50 to 2 wt%. When the content of the compatible resin component exceeds 70 wt%, heat resistance, which is an advantage of the styrene polymer having a syndiotactic configuration, may be undesirably spoiled. The other non-compatible resins which can be added to the polymer of the present invention include, a polyolefin such as polyethylene, polypropylene, polybutene, polypentene; a polyester such as polyethylene terephthalate, polybutylene terephthalate, polyethylene naphthalate; a polyamide such as nylon-6, nylon-6,6; a polythioether such as polyphenylene sulfide; a polycarbonate; a polyarylate; a polysulfone; a polyether ether ketone; a polyethersulfone; a polyimide; a halogenated vinyl polymer such as Teflon; an acrylic polymer such as polymethyl methacrylate; a ployvinyl alcohol, and all but the aforementioned compatible resins. There are also cross linked resins containing the aforementioned compatible resins.

When the styrene polymer of the present invention having a syndiotactic configuration contains a small amount of the above resin, such resin, which is incompatible with said styrene polymer having a syndiotactic configuration, can be dispersed like islands in the styrene polymer. Accordingly, it is effective to provide proper gross and to improve smoothness of the surface after stretching. The content of these non-compatible resin is 50 to 2 wt% for the purpose of providing gloss, and 0.001 to 5 wt% for the purpose of controlling the surface properties. When the temperature at which the product is used is high, a non-compatible resin with heat resistance is preferably used.

Inorganic filler, antioxidant, antistatic agent, pigment or the like may be added to thus produced styrene polymer, so long as they do not inhibit the objective effect of the present invention.

In this case, the inorganic filler includes, for example, oxide, hydroxide, sulfide, nitride, halide, carbonate, acetate, phosphate, phosphite, organic carboxylate, silcate, titanate or borate of the group IA, IIA, IVA, VIA, VIIA, VIII, IB, IIB, IIIB or IVB element, and hydrate compound thereof, complex compound containing them as a center, natural mineral particles. For example, group IA element compound such as lithium fluoride, borax (hydrate salt of sodium borate); group IIA element compound such as magnesium carbonate, magnesium phosphate, magnesium oxide (magnesia), magnesium chloride, magnesium acetate, magnesium fluoride, magnesium titanate, magnesium silicate, hydrate salt of magnesium silicate (talc), calcium carbonate, calcium phosphate, calcium phosphite, calcium sulfate (gypsum), calcium acetate, calcium terephthalate, calcium hydroxide, calcium silicate, calcium fluoride, calcium titanate, strontium titanate, barium carbonate, barium phosphate, barium sulfate, barium phosphite; group IVA element compound such as titanium dioxide (titania), titanium monooxide, titanium nitride, zirconium dioxide (zirconia), zirconium monooxide; group VIA element compound such as molybdenum dioxide, molybdenum trioxide, molybdenum sulfide; group VIIA element compound such as manganese chloride, manganese acetate; group VIII element compound such as cobalt chloride, cobalt acetate; group IB element compound such as copper iodide; group IIB element compound such as zinc oxide, zinc acetate; group IIIB element compound such as aluminum oxide (alumina), aluminum hydroxide, aluminum fluoride, aluminosilicate (alumina silicate, kaolin, kaolinite); group IVB element compound such as silicon oxide (silica, silica gel), plumbage, carbon, graphite, glass; particulate natural mineral such as carnallite, kainite, isinglass (mica, phlogopite) and pyrolusite.

The film constituting the layer A of the present invention is a film which comprises the above materials and is 20 to 500 μm thick, having haze of not more than 3%. In order to obtain a film having a thickness and haze within the above range, those with considerably low crystallization rate are preferred. For example, (1) the above styrene polymer polymerized by an aromatic hydrocarbon solvent with solubility parameter $\delta \geqq 8.5$ $(cal/cm^3)^{\frac{1}{2}}$, (2) the above styrene polymer which is prepared by compounding the above compatible thermoplastic resin, (3) the above styrene polymer wherein a random·copolymer is contained in the amount of not more than 30 mol%. The solvent in the above (1) includes benzene, alkyl benzene such as toluene, ethylbenzene, xylene, propylbenzene, as well as styrene monomer during bulk polymerization such as styrene, alkylstyrene, halogenated styrene. The method for compounding the compatible thermoplastic resin in the above (2) is not limited. A method wherein the resin may be added or simultaneously produced in polymerization step or a melt mixing method is preferred.

In order to obtain a film having the above properties in the layer A of the present invention, the residual styrene monomer content in the styrene polymer or a composition thereof should be preferably not more than 7,000 ppm. Such styrene polymer or a composition thereof may be prepared by the following methods:

(1) A method wherein styrene polymer after polymerization or additional treatment is dried under reduced pressure. For drying under reduced pressure, it is effective to set the drying temperature to the temperature higher than glass transition temperature of the polymer.

(2) A method wherein the product obtained in the method (1) is further degassed by an extruder and, at the same time, it is made into a material for molding (pellet). In this step, a vented extruder is preferably used. Either a uniaxial or biaxial extruder may be used.

When the residual volatile monomer content exceeds 7,000 ppm, the product may be foamed during extrusion, or the surface may become rough during stretching, undesirably resulting in haze exceeding 3%.

A film constituting the layer A is prepared using the aforementioned styrene polymer of the present invention or a composition containing said polymer as a starting material. The operation for produclion of the film may be sufficiently carried out under such conditions that the aforementioned object can be attained, and not particularly limited. For example, it can be produced by heat melting, extrusion, cooling and solidification. An extruder used in this process may be either a uniaxial extruder or a biaxial extruder, with or without a vent. A uniaxial tandem type is preferred. A suitable mash may be used in an extruder to grind or remove the secondary agglomerate, or to remove contaminants and foreign matters.

The extrusion conditions are not particularly limited and properly selected depending on the various circumstances. Preferably, the temperature is selected in the range from melting point to 50° C. higher than decomposition temperature of the material for molding. The die used is a T-die, a ring die or the like.

After the above extrusion, the resulting pre-molded product (raw sheet) is cooled and solidified. As a refrigerant used in this step, for example, gas, liquid, metal roller and the like may be used. When a metal roller is used, air knife, air chamber, touch roll, electrostatic application and the like may be effectively used to prevent uneven thickness and surge.

The temperature of cool solidification is generally 0° C. to 30° C. higher than glass transition temperature of the raw sheet, preferably from 50° C lower than glass transition temperature to glass transition temperature. The cooling rate is properly selected within the range from 200 to 3° C./sec. The thickness of thus obtained raw sheet is in the range from 100 to 5,000 μm.

Subsequently, the cooled and solidified raw sheet is preferably uni- or biaxially stretched. For biaxial stretching, transverse direction (TD) stretching and machine direction (MD) stretching may be simultaneously conducted, or successively conducted in suitable order. Stretching may be conducted in one step, or in multiple steps..

There are various methods for stretching, for example, a method using a tenter, a method wherein the product is stretched between rollers, a method by bubbling using a pressure of a gas, a method by rolling. These methods may be applied singly or in a combination. The temperature for stretching is generally set between glass transition temperature and melting point of the raw sheet. For successive stretching or multi-step stretching, it is preferable to carry out the first step in the range between glass transition temperature and cold crystallization temperature, and the following steps in the range between glass transition temperature and melting point. The stretching rate is generally $1\times10$ to $1\times10^5$%/min., preferably, $1\times10^3$ to $1\times10^5$%/min. The stretching ratio is not particularlr limited, preferably it is at least 6. When it is less than 6, a film with sufficient mechanical properties and moisture expansion coefficient can not be obtained.

It is preferable to conduct heat setting (or annealing) of the stretched film obtained by stretching under the aforementioned conditions to enhance dimensional stability, heat resistance, strength balance of the surface of the film. Heat setting may be conducted by the usual method. It can be conducted by maintaining the stretched film in the temperature range from glass temperature to melting point of the film, preferably, from upper limit of the environment to melting point, for 0.5 to 180 seconds under a state of tension, a relaxed state or a state of controlling shrinkage. Such heat setting may be conducted at least twice changing the conditions within the above range. The heat setting may be conducted in an atmosphere of inert gas such as argon gas, nitrogen gas or the like. Without such heat setting, deformation particularly around glass transition temperature may often occur, resulting in limitation upon processing or usage.

Further, the conditions for stretching and heat setting are controlled to keep the absolute value of birefringence $|\Delta n|$ below $40\times10^{-3}$, advantageously providing a film excellent in physical properties such as transparency.

Thus obtained stretched film of styrene polymer or a composition thereof which is 20 to 500 μm thick, particularly at least 50 μm, wherein haze is not more than 3% and moisture expansion coefficient is not more than $1\times10^{-6}$, can be used as the layer A of the present invention.

The photographic film of the present invention comprises a film of the layer A as a substrate and the photosensitive layer of the layer B laminated thereon. The surface of the layer A may be corona treated to enhance the adhesion between the layer A and the adjacent layer.

The photosensitive layer, the layer B, of the present invention may be properly selected depending on the object and types of the photosensitive materials, and laminated by the usual methods. For example, the photographic film with the photosensitive layer includes (1) a silver salt photographic film using a silver salt photosensitive material, (2) a diazo photosensitive film using a diazo photosensitive material, (3) a photochromic film using a photochromic sensitized material or (4) a thermoplastic recording film using a photoconductive material.

Each film will be explained. As a base film, the above layer A may be used.

Firstly, (1) a silver salt photographic film basically comprises a protective layer, a silver salt photosensitive layer, an undercoating layer, a base film, and a back coating layer. As the protective layer, various kinds of gelatins may be used. The silver salt photosensitive layer is a gelatin emulsion layer which comprises a photosensitive silver salt such as silver bromide, chromic salt, silver salt and gelatin as a binder. The undercoating layer is selected considering adhesion between the base film and the gelatin emulsion layer. For example, there can be mentioned natural polymer such as gelatin, casein; polyvinylalcohol and their derivative, a copolymer of maleic anhydride and methyl vinyl ether, vinyl acetate, methyl methacrylate, styrene or the like, a copolymer of methacrylic acid, acrylic acid, itaconic acid or the like and vinyl acetate, methyl methacrylate, styrene or a mixture thereof.

Color photographic comprises the several silver salt photosensitive layers wherein a color coupler is dispersed, an intermediate gelatin layer and a filter layer.

Further, in addition to the above laminates, for example, an antihalation layer, an antistatic layer may be laminated on the silver salt photosensitive layer. X-ray photograph is one of the applications of the silver photosensitive material. In this case, the both sides of the base film (a base material) of the present invention are provided with gelatin emulsion layers which are photosensitive.

Lamination of the layers may be generally conducted by coating. Thickness of each layer is as follows:

a base film: 20 to 500 μm, preferably, 25 to 300 μm, more preferably, 75 to 250 μm;

a gelatin emulsion layer: 1 to 50 μm, preferably, 3 to 30 μm;

a protective layer: 0.01 to 10 μm, preferably, 0.1 to 5 μm;

a backcoating layer: 0.01 to 20 μm, preferably, 0.1 to 10 μm;

an undercoating layer: 10 μm or less, preferably, 5 μm or less.

(2) The diazo photosensitive film will be explained. The diazo photosensitive material usually comprises a diazo photosensitive layer, a base film, and a backcoating layer. The diazo photosensitive layer comprises a composition consisting of an ordinary diazonium salt and a coupler, and a binder. The binder used for such photosensitive layer includes, for example, polyvinylalcohol binder; cellulose binder such as cellulose acetate butyrate, nitrocellulose, cellulose acetate; vinyl chloride binder such as polyvinylidene chloride, polyvinyl chloride-vinyl acetate; polymethacrylate binder such as polyacrylate, polystyrene-acrylate binder such as polystyrene-maleate, polyamide binder. The diazo photosensitive layer consisting of such binder is formed on one side of the base film in the thickness of 0.1 to 15 μm, preferably, 2 to 8 μm.

When a backcoating layer is formed on the film, it is coated in a thickness of 0.1 to 15 μm, preferably, 2 to 8 μm. Such a backcoating layer is formed to prevent the film from curling and to solve the problem of scratch.

Thickness of the layer A of the diazo photosensitive material (base film) is 25 to 500 μm, preferably, 38 to 300 μm. If necessary, suitable adhesive layer, anchor coat layer may be formed on the layer A.

(3) The photochromic film comprises the above layer A, on which are coated spiro pyrane as a photosensitive material (a cyclic compound containing a carbon atom common to two rings) and a binder. Thickness is 0.1 to 15 μm.

(4) The thermoplastic recording film comprises a thermoplastic resin layer containing a transparent photoconductive material, transparent or reflective conductive layer, and a base film. Deposited gold, copper, conductive tin oxide or the like may be used for the transparent conductive layer, and deposited aluminum layer or the like may be used for a reflection conductive layer. The preferably method for lamination comprises lamination of a transparent conductive layer (50 to 5,000 Å) on a base film by deposition, followed by application of thermoplastic resin containing photoconductive material (thickness, 0.5 to 5 μm).

Thus obtained photographic films using the layer A of the present invention as a base film are excellent in various properties.

Thus obtained photographic film of the present invention, using a film with excellent properties as a base film, is lighter than the conventional photographic film, and has extremely excellent mechanical properties, dimensional stability and the like.

Accordingly, the photographic film of the present invention may be widely used as photographic film for white-and-black photography, color photography, photomechanical process, X-ray photography, duplication and the like.

The present invention will be described in more detail with reference to examples and comparative examples.

PRODUCTION EXAMPLE 1

(1) Preparation of a contact product (a reaction product) of trimethylaluminum and water In a 500-milliliter glass vessel which had been purged with argon were placed 17.8 g (71 mmol) of copper sulfate pentahydrate ($CuSO_4 \cdot 5H_2O$), 200 ml of toluene and 24 ml (250 mmol) of trimethylaluminum, which were then reacted at 40° C. for 8 hours. Then, solid component was separated from the reaction mixture to prepare solution, and toluene was distilled away from the solution as obtained above under reduced pressure at room temperature to obtain 6.7 g of a contact product. The molecular weight of the product as determined by the freezing point depression method was 610.

(2) Production of styrene polymer

In a 2 liter reactor were placed 1 L (L=liter) of pure styrene, 5 mmol as aluminum atom of the contact product obtained in (1) above, 5 mmol of triisobutylaluminum, 0.025 mmol of pentamethylcyclopentadienyltitanium trimethoxide, and polymerization was carried out at 90° C. for 5 hours. After the reaction was over, a catalyst component in the resulting product was decomposed with sodium hydroxide in methanol, then the resultant was repeatedly washed with methanol and dried to give 308 g of a polymer. Weight average molecular weight of the resulting polymer measured by gel permeation chromatography at 135° C. using 1,2,4-trichlorobenzene as a solvent was 389,000, and the value of weight average molecular weight/number average molecular weight was 2.64. The resulting polymer was confirmed to be a polystyrene having a syndiotactic configuration by measurement of melting $^{13}C$-NMR spectrum.

PRODUCTION EXAMPLE 2

The procedure of Production Example 1 (2) was repeated except that 500 ml of heptane was added as a polymerization solvent during polymerization, and a polystyrene having a syndiotactic configuration, wherein weight average molecular weight was 412,000 and weight average molecular weight/number average molecular weight was 2.28, was obtained.

PRODUCTION EXAMPLE 3

The procedure of Production Example 2 was repeated except that copolymerization was carried out using 950 ml of styrene and 50 ml of p-methylstyrene as starting monomers. The resulting copolymer had syndiotactic configuration and was confirmed to contain 9.5 mol% of p-methylstyrene unit by $^{13}C$-NMR. Weight average molecular weight was 438,000 and weight average molecular weight/number average molecular weight was 2.51.

EXAMPLE 1

The styrene polymer obtained in Production Example 1 was dried under reduced pressure at 150° C. and pelletized using a vented uniaxial extruder. This pellet was crystallized while stirring in a hot air at 130° C. The styrene monomer content in the crystallized pellet was 1,100 ppm.

Then, the pellet was extruded by an extruder equipped with a T-die at the tip thereof and having a filter (250 mesh). Melt temperature was 330° C.

The molten sheet was molded into a 1 mm thick sheet having crystallinity of 12% using a touch roll take-off machine wherein the surface of the roller was adjusted to 55° C.

The obtained sheet was stretched sequentially in MD (3 times), in TD (3 times) and in MD (1.3 times) at 120° C. Subsequently, the product was heat-treated under a state of controlling shrinkage at 230° C. for 20 seconds. As for the film thus obtained, the thickness, haze and absolute value of birefrigence $|\Delta n|$ were 85 μm, 1.8 and $10\times10^{-3}$, respectively. Density of the film was 1.06 g/cm$^3$. Moisture expansion coefficient was measured by Thermal Mechanical Analysis (manufactured by Shinku Riko Co.) equipped with a moisture controller as an average value (20 %RH to 80 %RH) at room temperature. The result was $5\times10^{-7}$/%RH.

Subsequently, simulated X-ray photographic film, as a typical example of a silver salt photographic film, was prepared according to the following procedure and the performance was evaluated.

(1) Gelatin

One part of 4 wt% formalin was added to 9 parts of 5 wt% aqueous gelatin, which was coated on the above laminate film in such a way that thickness after drying was 0.7 μm, and dried at 100° C. for 3 minutes.

(2) Emulsion for X-ray photographic film

An emulsion described in "Photosensitive Materials for Photography and their Handling", by Goro Miyamoto, Kyoritsu Shuppan Co., 84 (1955) was used.

| (Solution A) | | (Solution B) | |
|---|---|---|---|
| Distilled Water | 50 cc | Distilled Water | 36 cc |
| Gelatin | 5 g | Silver Nitrate | 20 g |
| Potassium Bromide | 17 g | 30% Aqueous Ammonia | 2 cc |
| Potassium Iodide | 0.4 g | | |
| Citric Acid | 1 g | | |

(3) Protective membrane and backcoating gelatin layer

One part of 4% formalin was added to 9 parts of 2 wt% aqueous gelatin, which was coated on the emulsion layer (0.3 μm) and on the opposite side to the emulsion layer (7 μm), and dried at room temperature.

Using this photographic film, X-ray diffraction image of Al foil was photographed and developed. In this case, the condition of the image immediately after development and after 12 hours at 80° C. and 85 %RH, tensile test (JIS C2318) and density were determined. The results are shown in a table.

EXAMPLE 2

The procedure in Example 1 was repeated, except that a material containing 10 wt% of atactic polystyrene (HH-30E manufactured by Idemitsu Petrochemical Co., Ltd.) was used for preparation of a base film. The results are shown in a table.

EXAMPLE 3

The procedure in Example 1 was repeated, except that styrene polymer of Production Example 3 was used. The results are shown in a table.

EXAMPLE 4

The procedure in Example 1 was repeated to prepare a base film, and simulated diazo photosensitive film having a photosensitive layer on one side and an anticurling layer on the other side was prepared as follows.

Forty milliliter of a 15 wt% solution of cellulose acetate butyrate (EAB-171 manufactured by Eastmann Co.) in ethyl acetate, 1.5 g of 4-diazo-N,N'-diethylaniline chloride zinc chloride double salt, 1.5 g of tartaric acid, 1.2 g of β-resorcynic acid ethanol amine, 0.01 g of oil blue and 60 ml of methanol were mixed, and coated onto a base film, which was dried at 100° C. for 3 minutes to give a 6 μm thick diazo photosensitive layer.

As anticurling layer, only cellulose acetate butyrate was coated on the other side and dried in the same manner.

Copy was contacted on thus obtained diazo photosensitive layer and exposed to mercury lump, dipped in 10% aqueous monoethanolamine for 2 seconds and developed. The results are shown in a table.

Comparative Example 1

The procedure in Example 1 was repeated, except that the polymer of Preparation Example 2 was used and stretched at 135° C. The results are shown in a table.

Comparative Example 2

The procedure in Example 1 was repeated, except that an atactic polystyrene (HH-30E manufactured by Idemitsu Petrochemical Co., Ltd.) was used and melt temperature was set at 220° C. and the heat treatment was not conducted. Thus, a film and a photographic film were prepared. The results are shown in a table.

Comparative Example 3

The procedure of Example 1 was repeated using polyethylene terephthalate (Tetoron OP3 manufactured by Teijin Co., 75 μm). The results are shown in a table.

TABLE

| | Layer A (Base Film) | | | | Photographic Film | | | | |
|---|---|---|---|---|---|---|---|---|---|
| | | | | | | | Before | After Treatment[3] | |
| Example No. | Resin[1] | Haze[2] | Thickness (μm) | Moisture Expansion Coefficient (/ % RH) | Type | Specific Gravity | Treatment[3] Image | Image | Elastic Modulus |
| Example 1 | SPS | 1.8 | 85 | $5\times10^{-7}$ | Silver salt Photosensitive Film | 1.06 | Good | Good | Good |
| Example 2 | SPS/aPS | 1.6 | 85 | $5\times10^{-7}$ | Silver salt Photosensitive Film | 1.05 | Good | Good | Good |
| Example 3 | co-SPS | 1.4 | 85 | $5\times10^{-7}$ | Silver salt Photosensitive Film | 1.06 | Good | Good | Good |
| Example 4 | SPS | 1.8 | 85 | $5\times10^{-7}$ | Diazo Photosensitive Film | 1.06 | Good | Good | Good |
| Comparative Example 1 | SPS | 4.5 | 85 | $6\times10^{-7}$ | Silver salt Photosensitive Film | 1.06 | Bad | — | — |

TABLE-continued

| | Layer A (Base Film) | | | | Photographic Film | | | | |
|---|---|---|---|---|---|---|---|---|---|
| | | | | | | | Before | After Treatment[3] | |
| Example No. | Resin[1] | Haze[2] | Thickness (μm) | Moisture Expansion Coefficient (/ % RH) | Type | Specific Gravity | Treatment[3] Image | Image | Elastic Modulus |
| Comparative Example 2 | aPS | 1.4 | 85 | $1.2 \times 10^{-6}$ | Silver salt Photosensitive Film | 1.04 | Good | Bad | Acceptable |
| Comparative Example 3 | PET | 2.1 | 75 | $1.0 \times 10^{-5}$ | Silver salt Photosensitive Film | 1.39 | Good | Bad | Bad |

[1]SPS: Syndiotactic polystyrene
aPS: Atactic polystyrene
co-SPS: Syndiotactic (styrene-p-methylstyrene) copolymer
PET: Polyethylene terephthalate
[2]Measured according to JIS K 705
[3]Development properties
Before treatment (immediately after development)
Image
Good: Al diffraction point clearly came out.
Bad: High dimensional Al diffraction point was unclear.
After treatment (treated at 90° C., 85% RH for 12 hours)
Image
Good: Same as defined for that immediately after development.
Bad: Image was dislocated due to, for example, warp, shrinkage of the film.
Elastic Modulus: Measured by a solid visco-elasticity measuring device (spectrometer) at 30° C.
Good: ≧40,000 kg/cm$^2$
Acceptable: 25,000–40,000 kg/cm$^2$
Bad: ≦25,000 kg/cm$^2$

What is claimed is:

1. A photographic film which comprises:

(A) a stretched film comprising a styrene polymer having a syndiotactic configuration with thickness of 20 to 500 μm, haze of not more than 3% and moisture expansion coefficient of not more than $1\times10^{-6}$/% RH, stretched at a stretching ratio of at least 6, and (B) a photosensitive layer comprising a silver salt photosensitive material.

2. The photographic film according to claim 1, wherein weight average molecular weight of the styrene polymer is from 10,000 to 3,000,000.

3. The photographic film according to claim 1, wherein weight average molecular weight of the styrene polymer is from 50,000 to 1,500,000.

4. The photographic film according to claim 1, wherein weight average molecular weight/number average molecular weight is from 1.5 to 8.

5. The photographic film according to claim 1, wherein the layer A contains 70 to 1 wt% of compatible resin.

6. The photographic film according to claim 1, wherein the layer A contains 50 to 2 wt% of compatible resin.

7. The photographic film according to claim 1, wherein the layer A contains 50 to 2 wt% of non-compatible resin.

8. The photographic film according to claim 1, wherein the layer A contains 0.001 to 5 wt% of non-compatible resin.

9. The photographic film according to claim 1, which further contains inorganic filler, antioxidant, antistatic agent, or pigment.

10. The photographic film according to claim 1, wherein the residual styrene monomer content in the styrene polymer is not more than 7,000 ppm.

11. The photographic film according to claim 1, wherein the absolute value of the birefringence of the film of the layer A is controlled to below $40\times10^{-3}$.

12. The photographic film according to claim 1, which comprises a base film as the stretched film (A), a gelatin emulsion layer as the photosensitive layer (B), a protective layer, a backcoating layer and an undercoating layer.

13. The photographic film according to claim 12, wherein the thickness of the base film, the gelatin emulsion layer, the protective layer, the backcoating layer and an undercoating layer is 20 to 500 μm, 1 to 50 μm, 0.01 to 10 μm, 0.01 to 20 μm and not more than 10 μm, respectively.

* * * * *